US010792549B2

(12) United States Patent
Rivers

(10) Patent No.: US 10,792,549 B2
(45) Date of Patent: Oct. 6, 2020

(54) BASKETBALL TRAINING ASSEMBLY

(71) Applicant: John Rivers, Winnsboro, SC (US)

(72) Inventor: John Rivers, Winnsboro, SC (US)

( * ) Notice: Subject to any disclaimer, the term of this patent is extended or adjusted under 35 U.S.C. 154(b) by 0 days.

(21) Appl. No.: 16/291,834

(22) Filed: Mar. 4, 2019

(65) Prior Publication Data

US 2020/0282282 A1 Sep. 10, 2020

(51) Int. Cl.
*A63B 69/00* (2006.01)

(52) U.S. Cl.
CPC .... *A63B 69/0071* (2013.01); *A63B 2220/803* (2013.01); *A63B 2220/833* (2013.01); *A63B 2225/093* (2013.01); *A63B 2243/0037* (2013.01)

(58) Field of Classification Search
CPC ..... A63B 69/0071; A63B 63/083; A63B 2243/0037; A63B 2225/093; A63B 2225/09; A63B 2071/028; A63B 2220/803; A63B 2220/833
See application file for complete search history.

(56) References Cited

U.S. PATENT DOCUMENTS 1,304,602 A * 5/1919 Reid ..... F41J 7/00 273/406
4,565,527 A * 1/1986 Burchett ..... A63B 69/0071 273/371
5,584,480 A * 12/1996 Grimsrud ..... A63B 71/023 273/396
6,085,861 A * 7/2000 Jines ..... G10K 11/20 181/198
6,093,120 A * 7/2000 Luke, Jr. ..... A63B 69/0002 473/435
6,889,982 B1 * 5/2005 Gove ..... A63B 63/00 273/343
D539,373 S 3/2007 Cook
7,255,658 B1 * 8/2007 VanKuiken ..... A63B 69/0002 473/454
8,409,036 B1 * 4/2013 Khananayev ..... A63B 69/0071 473/416
8,529,382 B2 * 9/2013 Green ..... A63B 63/00 273/317.6
8,721,476 B2 5/2014 Mayers
8,900,074 B1 * 12/2014 Johnson ..... A63B 69/205 473/422
9,095,755 B1 * 8/2015 Hill ..... A63B 69/0071
9,757,637 B1 9/2017 Glaser
9,873,030 B2 * 1/2018 Frostino ..... A63B 69/0071
(Continued)

*Primary Examiner* — Melba Bumgarner
*Assistant Examiner* — Amir A Klayman

(57) ABSTRACT

A basketball training assembly includes a cart that is rollable along a support surface. The cart can be positioned a selected distance from a basketball hoop on a basketball court. A lift is coupled to and extends upwardly from the cart. The lift is turned on to extend a predetermined distance upwardly from a home position on the cart. A barrier is coupled to the lift and the lift lifts the barrier the predetermined distance from the home position when the lift is turned on to simulates a defensive basketball player. A plurality of motion sensors is each coupled to the barrier to sense motion of a basketball player approaching the barrier. The lift is turned on when one or more of the motion sensors senses motion. Thus, the lift lifts the barrier when the basketball player approaches the barrier to take a shot during basketball practice.

1 Claim, 5 Drawing Sheets

(56) References Cited

U.S. PATENT DOCUMENTS

| | | | | |
|---|---|---|---|---|
| 10,065,097 | B2 * | 9/2018 | Sagle | A63B 69/0071 |
| 2004/0157685 | A1 * | 8/2004 | Hodges | A63B 69/0071<br>473/448 |
| 2005/0075198 | A1 * | 4/2005 | Rhyne, Jr. | A63B 69/0071<br>473/447 |
| 2005/0192126 | A1 * | 9/2005 | Remaklus | A63B 63/08<br>473/447 |
| 2007/0010354 | A1 * | 1/2007 | White | A63B 69/0071<br>473/447 |
| 2009/0149281 | A1 | 6/2009 | Johnson | |
| 2010/0160093 | A1 | 6/2010 | Macarthur | |
| 2012/0184401 | A1 * | 7/2012 | Shepherd | A63B 63/083<br>473/481 |
| 2015/0065273 | A1 | 3/2015 | Lake | |
| 2016/0193518 | A1 * | 7/2016 | Baxter | A63B 69/0071<br>473/450 |

* cited by examiner

BASKETBALL TRAINING ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to training devices and more particularly pertains to a new training device for simulating a defensive player blocking a basketball shot.

BRIEF SUMMARY OF THE INVENTION

An embodiment of the disclosure meets the needs presented above by generally comprising a cart that is rollable along a support surface. The cart can be positioned a selected distance from a basketball hoop on a basketball court. A lift is coupled to and extends upwardly from the cart. The lift is turned on to extend a predetermined distance upwardly from a home position on the cart. A barrier is coupled to the lift and the lift lifts the barrier the predetermined distance from the home position when the lift is turned on to simulate a defensive basketball player. A plurality of motion sensors is each coupled to the barrier to sense motion of a basketball player approaching the barrier. The lift is turned on when one or more of the motion sensors senses motion. Thus, the lift lifts the barrier when the basketball player approaches the barrier to take a shot during basketball practice.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
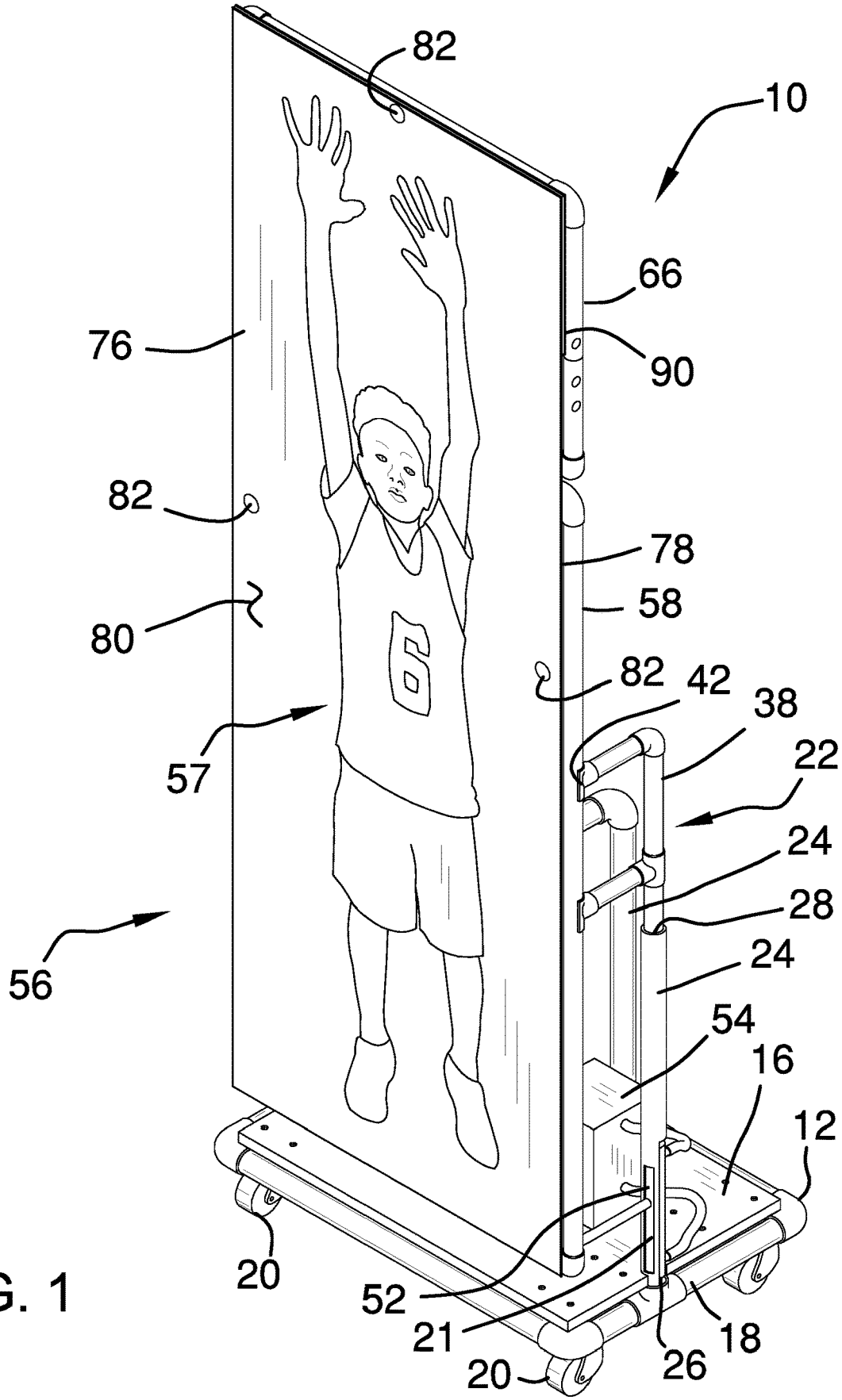
FIG. 1 is a front perspective view of a basketball training assembly according to an embodiment of the disclosure.
Figure 2:
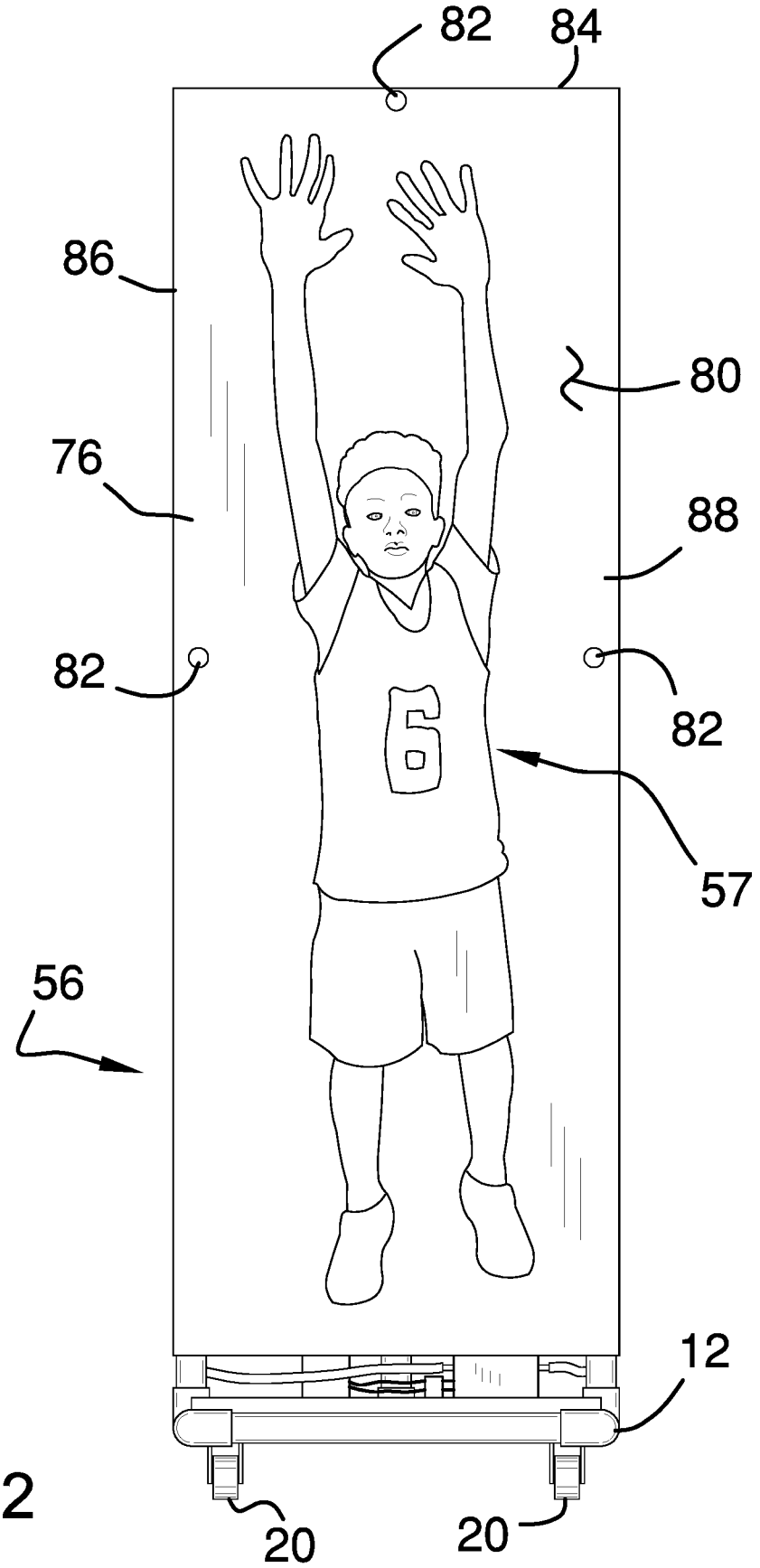
FIG. 2 is a front view of an embodiment of the disclosure.
Figure 3:
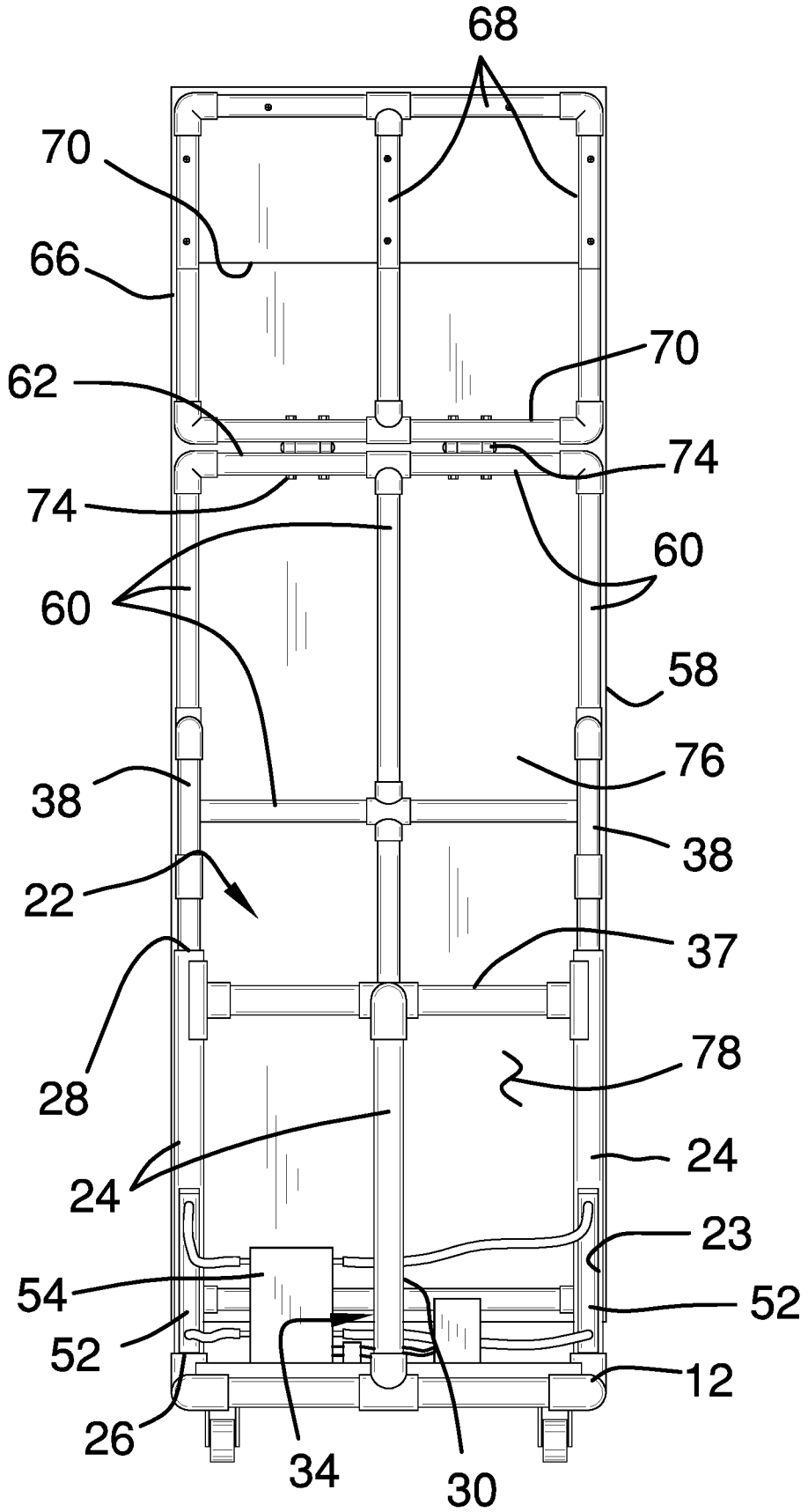
FIG. 3 is a back view of an embodiment of the disclosure.
Figure 4:
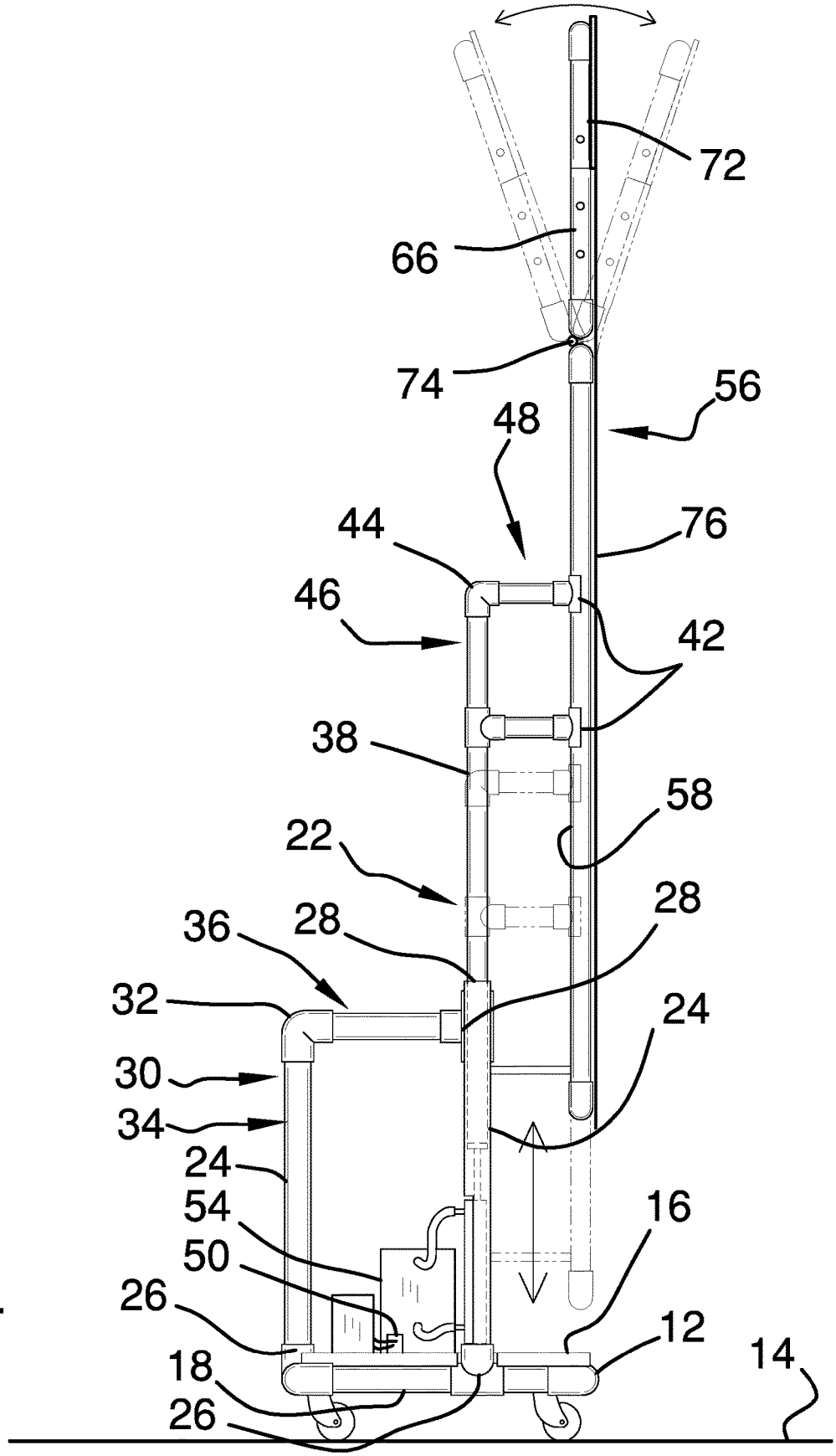
FIG. 4 is a left side view of an embodiment of the disclosure showing a lift moving upwardly from a home position.
Figure 5:
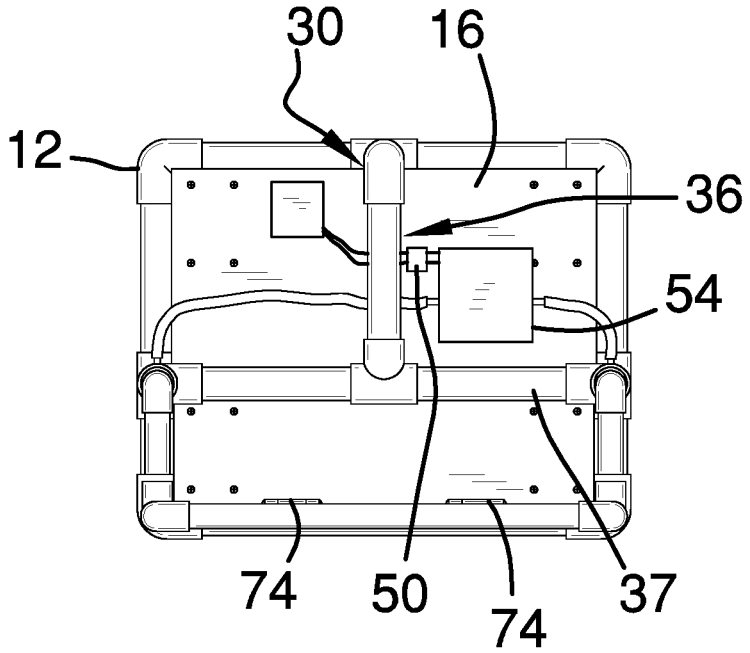
FIG. 5 is a top view of an embodiment of the disclosure.
Figure 6:
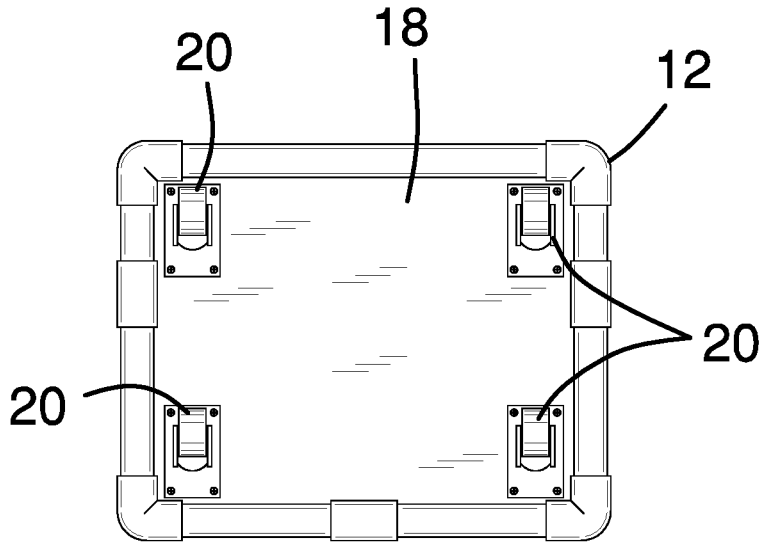
FIG. 6 is a bottom view of an embodiment of the disclosure.

With reference now to the drawings, and in particular to FIGS. 1 through 6 thereof, a new training device embodying the principles and concepts of an embodiment of the disclosure and generally designated by the reference numeral 10 will be described.

As best illustrated in FIGS. 1 through 6, the basketball training assembly 10 generally comprises a cart 12 that is rollable along a support surface 14. Additionally, the cart 12 is positioned a selected distance from a basketball hoop on a basketball court or the like. The cart 12 has a top side 16 and a bottom side 18, and a plurality of rollers 20 is each rotatably coupled to the cart 12 for rolling on the support surface 14. Each of the rollers 20 is positioned on the bottom side 18 and is aligned with a respective one of four corners of the cart 12.

A lift 22 is coupled to and extends upwardly from the cart 12. The lift 22 is turned on to extend a predetermined distance upwardly from a home position on the cart 12. Additionally, the lift 22 is turned off to return to the home position. The lift 22 comprises a plurality of lower tubes 24 that each has a lower end 26 and an upper end 28. The lower end 26 of each of the lower tubes 24 is coupled to the top side 16 of the cart 12 having each of the lower tubes 24 being vertically oriented. Moreover, each of the lower tubes 24 is positioned adjacent to and is centrally positioned along a respective edge of the cart 12 such that the plurality of lower tubes 24 defines three points of a triangle.

The plurality of lower tubes 24 includes a rear lower tube 30. The rear lower tube 30 has a bend 32 positioned between the lower 26 and upper 28 ends of the rear lower tube 30. Thus, a first portion 34 of the rear lower tube 30 is defined that forms an angle with respect to a second portion 36 of the rear lower tube 30. Additionally, the second portion 36 is horizontally oriented. A brace 37 extends laterally between the rear lower tube 30 and each of the lower tubes 24 for retaining each of the lower tubes 24 in the vertical orientation. Each of the lower tubes 24 may have a front slot 21 and a back slot 23 each extending through an outer wall 25 of the lower tubes 24. Each of the front 21 and back slots 23 may extend upwardly from the lower end 26 of the respective lower tube 24.

The lift 22 includes a plurality of upper tubes 38 that each has a bottom end 40 and a top end 42. The upper end 28 of each of the lower tubes 24 slidably receives the bottom end 40 of a respective one of the upper tubes 38. Each of the upper tubes 38 has a bend 44 thereon defining a primary section 46 forming an angle with a secondary section 48. Moreover, the secondary section 48 of each of the upper tubes 38 is horizontally oriented and the secondary section 48 of each of the upper tubes 38 has the top end 42 being associated therewith.

The lift 22 includes a control circuit 50 that is coupled to the cart 12 and the control circuit 50 receives a lift input. A plurality of actuators 52 is each positioned within a respective one of the lower tubes 24. Each of the actuators 52 engages the bottom end 40 of the upper tube 38 in the respective lower tube 24. Moreover, each of the actuators 52 elongates when the actuators 52 are turned on thereby lifting each of the upper tubes 38 a predetermined distance upwardly. Each of the actuators 52 retracts when the actuators 52 are turned off thereby lowering each of the upper tubes 38. Each of the actuators 52 may be pneumatic pistons, hydraulic pistons, electro-mechanical linear actuators or any other actuator capable of elongating and retracting along a longitudinal axis.

A power source 54 is coupled to the cart 12 and the power source 54 is in operational communication with each of the actuators 52 for turning each of the actuators 52 on. The power source 54 is electrically coupled to the control circuit 50. Thus, the power source 54 turns on each of the actuators 52 when the control circuit 50 receives the lift input. Additionally, the power source 54 turns off each of the actuators 52 a predetermined duration of time after the control circuit 50 receives the lift input. The power source 54 may include an air compressor in fluid communication with each of the actuators 52, a hydraulic pump in fluid communication with each the actuators 52 or a battery in electrical communication with each of the actuators 52.

A barrier 56 is coupled to the lift 22 and indicia 57 are printed on the barrier 56. The indicia 57 comprise an image of a defensive basketball player. The lift 22 lifts the barrier 56 the predetermined distance from the home position when the lift 22 is turned on. In this way the barrier 56 simulates the defensive basketball player jumping to block a shot. Additionally, the barrier 56 is lowered to the home position when the lift 22 is turned off.

The barrier 56 comprises a first frame 58 that includes a plurality of intersecting first members 60 such that the first frame 58 has a rectangular shape, and the intersecting first members 60 include a top member 62. The top end 42 of each of the upper tubes 38 of the lift 22 is coupled to a respective one of the first members 60 such that the first frame 58 lies on a plane that is vertically oriented. Moreover, the first frame 58 is lifted upwardly when the actuators 52 are turned on and the first frame 58 is lowered into the home position when the actuators 52 are turned off. The first frame 58 has a front side 63 and a back side 64, and each of the upper tubes 38 engages the back side 64.

The barrier 56 includes a second frame 66 comprising a plurality of intersecting second members 68 such that the second frame 66 has a rectangular shape, and the intersecting second members 68 include a bottom member 70. The bottom member 70 is pivotally coupled to the top member 62 associated with the first frame 58, and the second frame 66 has a forward side 72. The second frame 66 lies on a plane that is vertically oriented when the second frame 66 is positioned in a first position. Moreover, the second frame 66 lies on a plane that is oriented at an angle with the first frame 58 when the second frame 66 is positioned in a second position.

A plurality of hinges 74 is each coupled between the top member 62 associated with the first frame 58 and the bottom member 70 associated with the second frame 66. Each of the hinges 74 is biased to orient the second frame 66 on the vertical plane and each of the hinges 74 is urgeable to tilt the second frame 66. Each of the hinges 74 may be spring loaded hinges or other similar mechanically biased hinges. The barrier 56 includes a panel 76 that has a rear surface 78 and a front surface 80. The rear surface 78 of the panel 76 is coupled to the front side 63 of the first frame 58 and the forward side 72 of the second frame 66.

A plurality of motion sensors 82 is each coupled to the barrier 56 to sense motion of a basketball player approaching the barrier 56. Each of the motion sensors 82 is electrically coupled to the lift 22 and the lift 22 is turned on when one or more of the motion sensors 82 senses motion. Thus, the lift 22 lifts the barrier 56 when the basketball player approaches the barrier 56 to take a shot during basketball practice. Each of the motion sensors 82 is positioned on the front surface 80 of the panel 76 each of the motion sensors 82 is aligned with a respective one of a top edge 84, a first lateral edge 86 and a second lateral edge 88 of the panel 76. Additionally, each of the motion sensors 82 may be electronic motion sensors of any conventional design.

The panel 76 has a height that is equal to the combined height of the first 58 and second 66 frames, which may range between approximately 60.0 inches and 70.0 inches, and the indicia 57 is printed on the front surface 80 of the panel 76. Each of the panel 76, the first frame 58 and the second frame 66 may have a width ranging between approximately 20.0 inches and 25.0 inches. The second frame 66 may have a telescopically adjustable height, and an extension panel 90 may be coupled to the second frame 66. Thus, the extension panel 90 may be extendable upwardly beyond the top edge 84 of the panel 76 for increasing the overall height of the barrier 56.

In use, the cart 12 is rolled into a selected position proximate the basketball hoop having the panel 76 facing the basketball player that is practicing taking shots. The motion sensors 82 sense the motion of the basketball player when the basketball player approaches the panel 76 while taking a shot. Thus, the lift 22 is turned on to lift the panel 76 thereby simulating a defensive basketball player attempting to block the shot. In this way a basketball player can practice shooting over a defender without the assistance of an additional individual.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A basketball training assembly being configured to simulate a defensive player attempting to block a shot, said assembly comprising:

a cart being rollable along a support surface wherein said cart is configured to be positioned a selected distance from a basketball hoop, said cart having a top side and a bottom side;

a plurality of rollers, each of said rollers being rotatably coupled to said cart for rolling on the support surface, each of said rollers being positioned on said bottom side and being aligned with a respective one of four corners of said cart;

a lift being coupled to and extending upwardly from said cart, said lift being turned on to extend a predetermined distance upwardly from a home position on said cart, said lift being turned off to return to said home position, said lift comprising:

a plurality of lower tubes, each of said lower tubes having a lower end and an upper end, said lower end of each of said lower tubes being coupled to said top side of said cart having each of said lower tubes being vertically oriented, each of said lower tubes being vertically aligned with and extending upwardly from a respective edge of said cart, said plurality of lower tubes including a rear lower tube, said rear lower tube having a bend positioned between said lower and upper ends of said rear lower tube thereby defining a first portion of said rear lower tube forming an angle with respect to a second portion of said rear lower tube, said second portion being horizontally oriented;

a plurality of upper tubes, each of said upper tubes having a bottom end and a top end, said upper end of each of said lower tubes slidably receiving said bottom end of a respective one of said upper tubes, each of said upper tubes having a bend thereon defining a primary section forming an angle with a secondary section, said secondary section of each of said upper tubes being horizontally oriented;

a control circuit being coupled to said cart, said control circuit receiving a lift input;

a plurality of actuators, each of said actuators being positioned within a respective one of said lower tubes, each of said actuators engaging said bottom end of said upper tube in said respective lower tube, each of said actuators elongating when said actuators are turned on thereby lifting each of said upper tubes a predetermined distance upwardly, each of said actuators retracting when said actuators are turned off thereby lowering each of said upper tubes;

a power source being coupled to said cart, said power source being in operational communication with each of said actuators for turning each of said actuators on, said power source being electrically coupled to said control circuit, said power source turning each of said actuators on when said control circuit receives said lift input, said power source turning each of said actuators off a predetermined duration of time after said control circuit receives said lift input;

a barrier being coupled to said lift, barrier having indicia being printed thereon, said indicia comprising an image of a defensive basketball player, said lift lifting said barrier said predetermined distance from said home position when said lift is turned on wherein said barrier is configured to simulate the defensive basketball player jumping to block a shot, said barrier being lowered to said home position when said lift is turned off, said barrier comprising:

a first frame comprising a plurality of intersecting first members such that said first frame has a rectangular shape, said intersecting first members including a top member, said top end of each of said upper tubes of said lift being coupled to a respective one of said first members such that said first frame lies on a plane being vertically oriented, said first frame being lifted upwardly when said actuators are turned on, said first frame being lowered into said home position when said actuators are turned off, said first frame having a front side and a back side, each of said upper tubes engaging said back side;

a second frame comprising a plurality of intersecting second members such that said second frame has a rectangular shape, said intersecting second members including a bottom member, said bottom member being pivotally coupled to said top member associated with said first frame, said second frame lying on a plane being vertically oriented when said second frame is positioned in a first position, said second frame being lying on a plane being oriented at an angle with said first frame when said second frame is positioned in a second position, said second frame having a forward side;

a plurality of hinges, each of said hinges being coupled between said top member associated with said first frame and said bottom member associated with said second frame, each of said hinges being biased to orient said second frame on said vertical plane, each of said hinges being movable to tilt said second frame; and a panel having a rear surface and a front surface, said rear surface being coupled to said front side of said first frame and said forward side of said second frame, said panel having a height being equal to a height of said first and second frames, said indicia being printed on said front surface; and a plurality of motion sensors, each of said motion sensors being coupled to said barrier wherein each of said motion sensors is configured to sense motion of a basketball player approaching said barrier, each of said motion sensors being electrically coupled to said lift, said lift being turned on when one or more of said motion sensors senses motion wherein said lift is configured to lift said barrier when the basketball player approaches said barrier to take a shot during basketball practice, each of said motion sensors being positioned on said front surface of said panel each of said motion sensors being aligned with a respective one of a top edge, a first lateral edge and a second lateral edge of said panel.

* * * * *